United States Patent [19]

Butterfield

[11] 4,429,803

[45] Feb. 7, 1984

[54] BROKEN SEAL DETECTOR

[75] Inventor: Ida M. Butterfield, Santa Maria, Calif.

[73] Assignee: Butterfield Group, Santa Maria, Calif.

[21] Appl. No.: 363,925

[22] Filed: Mar. 31, 1982

[51] Int. Cl.[3] ..... B65D 51/24

[52] U.S. Cl. ..... 215/366; 215/230; 215/247; 215/250; 604/111

[58] Field of Search ..... 215/247, 248, 249, 366, 215/365, 230, 228, 250; 206/807; 604/110, 111, 318, 404

[56] References Cited

U.S. PATENT DOCUMENTS 4,261,474 4/1981 Cohen ..... 215/247 X

*Primary Examiner*—Donald F. Norton

*Attorney, Agent, or Firm*—Daniel C. McKown

[57] ABSTRACT

It is difficult to detect whether the rubber seal on a vial or on a hypodermic syringe cartridge has been penetrated, because the rubber seal over the mouth of the container is purposely soft and self-sealing to prevent contamination of the fluid within the container. As a result pilfering of narcotics from such containers has gone largely undetected. To remedy this situation, a blister-like sac of a plastic film and containing a harmless dye is mounted within the mouth of the container between the rubber seal and the contents of the container. It is impossible for a hypodermic needle to be inserted through the seal and into the fluid within the container without puncturing the blister-like sac and thereby releasing the harmless dye into the fluid within the container. Thus, if the seal has been broken, the fluid in the container will be tinted with the color of the harmless dye.

2 Claims, 2 Drawing Figures

BROKEN SEAL DETECTOR

BACKGROUND OF THE INVENTION

1. Field of the Invention

The present invention is in the field of medical equipment and more specifically relates to a device for detecting that a multiple-dose vial or a hypodermic syringe cartridge has been broken into.

2. The Prior Art

Injectable mediciments, including narcotics, are typically supplied either in hypodermic syringe cartridges or in multiple-dose vials. Both of these containers are typically made of glass and are commonly sealed by a soft rubber disc which fits over the mouth of the container and which is secured to the container by a swaged metal closure. The metal closure includes an aperture that is aligned with the mount of the container but is located on the opposite side of the rubber seal. Fluid is withdrawn from the multiple-dose vial by inserting the needle of a hypodermic syringe through the rubber seal so that the tip of the needle extends into the container, thereby permitting the contends of the container to be aspirated by the hypodermic syringe.

In the case of a hypodermic syringe cartridge, of a type common in the art, there is provided a hollow hypodermic needle, pointed at both ends and which extends through a plastic cap. When the plastic cap is snapped over the end of the cartridge, one end of the hypodermic needle is forced through the rubber seal of the cartridge, thereby permitting fluid inside the cartridge to be expressed through the needle.

There have been instances of persons removing, without authorization, narcotics from such containers and replacing the removed fluid by a different fluid, such as water or a saline solution. It is difficult to detect whether the rubber seal on a vial or cartridge has been penetrated, because the rubber seal is purposely soft and self-sealing to prevent contamination or exposure of the fluid within the container. As a result, such pilfering of narcotics has gone largely undetected, and the patients receiving the injections have not experienced the expected benefits. The present invention evolved from a desire to remedy this situation.

SUMMARY OF THE INVENTION

In accordance with the present invention, a blister-like sac of a plastic film and containing a harmless dye is mounted within the mouth of the container immediately beneath the rubber seal. In this arrangement, it is impossible for a hypodermic needle to be inserted through the seal and into the fluid within the container without puncturing the blister-like sac and thereby releasing the harmless dye into the fluid within the container. Thus, if the seal has been broken, the fluid in the container will be tinted with the color of the harmless dye.

The novel features which are believed to be characteristic of the invention, together with further objects and advantages thereof, will be better understood from the following description considered in connection with the accompanying drawings in which two preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
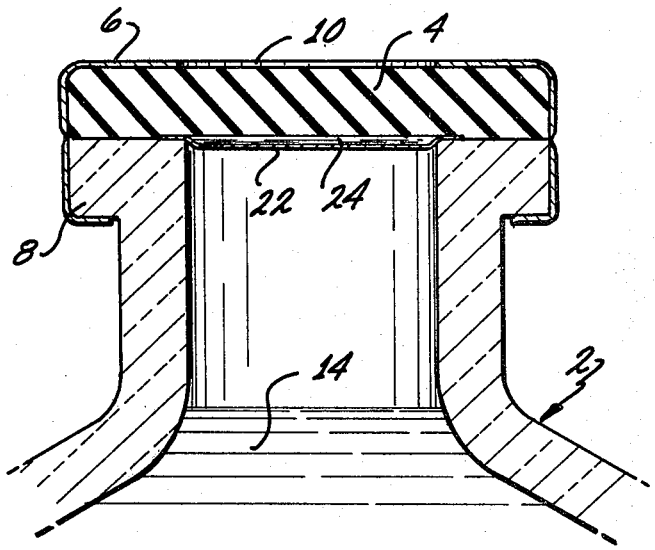
FIG. 1 is a fractional cross-sectional view showing a preferred embodiment of the broken seal detector of the present invention mounted in the mouth of a multiple-dose vial.

Turning now to the drawings in which like parts are denoted by the same reference numerals throughout, there are shown in FIG. 1 the neck and mouth portions of a multiple-dose vial 2 in which the detector of the present invention has been mounted. As is common in the prior art, the multiple-dose vial is sealed by a rubber seal 4 which extends cross the mouth of the container 2. The rubber seal 4 is held in place on the container 2 by means of the metal closure 6 which is swaged around the lip 8 of the container. The metal closure 6 includes an aperture 10 to permit a hypodermic needle to be inserted through the rubber seal 4 and into the container, for the purpose of withdrawing some of the fluid 14 that is stored within the container.

In accordance with the present invention, a blister-like sac 22 filled with a harmless dye 24 is mounted in the mouth of the container 2. In a preferred embodiment, the blister-like sac is formed of a thin plastic film. The harmless dye is preferably in the form of a liquid, although in an alternative embodiment, a fine powder is used.

Figure 2:
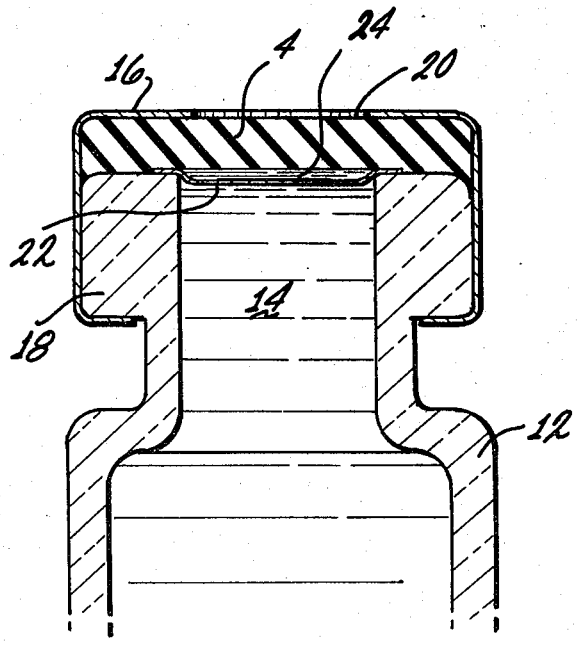
FIG. 2 is a fractional cross-sectional view showing a preferred embodiment of the broken seal detector of the present invention mounted in the mouht of a hypodermic syringe cartridge.

FIG. 2 shows the broken seal detector of the present invention applied to a hypodermic syringe cartridge. The cartridge 12 is normally supplied full of a fluid 14, and the cartridge is sealed by a rubber seal 4 that is held in place on the cartridge by the metal closure 16 that is swaged around the lip 18 of the cartridge. The metal closure 16 includes an aperture 20 to permit access to the fluid 14 by puncturing the rubber seal 4 with a hypodermic needle. It is noted that a considerable similarity exists between the structure of the multiple-dose vial of FIG. 1 and the hypodermic syringe cartridge of FIG. 2.

In accordance with the present invention, a blister-like sac 22 is mounted across the mouth of the cartridge 12 and the blister-like sac 22 contains the harmless dye 24. The blister-like sac 22 may be formed in the manner described above.

In one embodiment, the blister-like sac 22 is produced by spreading a first layer of the thin plastic film across the mouth of the container, applying a small amount of the harmless dye 24 to the first layer then covering the dye with a second layer of the plastic film and finally, bonding the two layers of plastic film together along an annular strip that encloses the mouth of the container.

In an alternative embodiment, the blister-like sac 22 is formed by spreading a single layer of plastic film across the mouth of the container, applying a small quantity of the harmless dye to the surface of the plastic film, and then applying the rubber seal 4 over the dye-coated plastic film.

In yet another embodiment, a patch of dye may be applied to the central area of the rubber seal 4 before the rubber seal is applied to the container. A single layer of plastic film is then applied over the patch of dye and is bonded to the rubber seal 4 along an annular region.

Thereafter, the rubber seal 4 including the blister-like sac is affixed to the mouth of the container in the manner shown in the drawings.

Thus, there has been described a device for detecting whether a particular type of container has been broken into, and a process for making the device. The foregoing detailed description illustrates a preferred embodiment of the invention, and it is to be expressly understood that additional variations thereof will be obvious to those skilled in the art. The embodiments described herein, together with those additional variations are considered to be within the scope of the invention.

What is claimed is:

1. An improvement for use in a container of the type having a mouth sealed by a closure that includes a rubber disc that in normal use is penetrated by a hypodermic needle to permit the fluid in the container to be withdrawn by aspiration, said improvement comprising:

a blister-like sac spanning the entire mouth of the container and containing a colorant, so that when the blister-like sac is penetrated by a hypodermic needle, some of the colorant will be released into the fluid in the container imparting a color to the fluid to indicate that the container has been broken into.

2. The improvement of claim 1 wherein said blister-like sac further comprises a thin plastic film.

* * * * *